US008196675B2

(12) United States Patent
Chang

(10) Patent No.: US 8,196,675 B2
(45) Date of Patent: Jun. 12, 2012

(54) IMPACT HAMMER WITH PRE-PRESSING DAMPING AND BUFFERING EFFECT

(75) Inventor: Ching-Shun Chang, Taichung (TW)

(73) Assignee: Sing Hua Industrial Co., Ltd., Da'an Township, Taichung County (TW)

( * ) Notice: Subject to any disclaimer, the term of this patent is extended or adjusted under 35 U.S.C. 154(b) by 311 days.

(21) Appl. No.: 12/730,396

(22) Filed: Mar. 24, 2010

(65) Prior Publication Data

US 2011/0232929 A1 Sep. 29, 2011

(51) Int. Cl.
*B25D 17/00* (2006.01)

(52) U.S. Cl. ..... 173/162.1; 173/162.2; 173/169; 173/211

(58) Field of Classification Search ..... 173/128, 173/168, 169, 162.1, 162.2, 109, 210, 211, 173/201
See application file for complete search history.

(56) References Cited

U.S. PATENT DOCUMENTS 2,019,964 A * 11/1935 Hamerly ..... 173/162.1
2,187,502 A * 1/1940 Shaff ..... 173/137
4,388,972 A * 6/1983 Gidlund ..... 173/162.1
5,322,131 A * 6/1994 Pressley et al. ..... 173/162.1
5,697,456 A * 12/1997 Radle et al. ..... 173/162.2
5,921,327 A * 7/1999 Henriksson et al. ..... 173/210
6,421,880 B1 * 7/2002 Prajapati et al. ..... 16/431
6,755,260 B1 * 6/2004 Allan ..... 173/162.2
7,322,428 B2 * 1/2008 Bacila ..... 173/162.2
7,523,790 B2 * 4/2009 Arakawa et al. ..... 173/162.2
7,527,107 B2 * 5/2009 Berger et al. ..... 173/162.2

* cited by examiner

*Primary Examiner* — Scott A. Smith
(74) *Attorney, Agent, or Firm* — Egbert Law Offices PLLC

(57) ABSTRACT

An impact hammer with pre-pressing damping and buffering effect includes a handle, outer barrel, air inlet, internal slide, actuating cylinder, air flow switching module and air inlet coupling portion. A front damper is assembled between the front end of the internal slide and the front end wall of the holding space and is characterized by a two-section pre-pressing rear damper assembled between the rear end of the internal slide and the rear end wall of the holding space. The two-section pre-pressing rear damper includes superposed upper and lower elastic buffers. At least the lower elastic buffer is pressed by a pre-pressing member to the preset degree. When the impact hammer yields recoil force under the impaction of the piston, the pre-pressing rear damper is employed to realize stronger buffering effect, so that the impact force is not much affected, thereby improving the impact efficiency and yielding excellent buffering effect.

7 Claims, 7 Drawing Sheets

IMPACT HAMMER WITH PRE-PRESSING DAMPING AND BUFFERING EFFECT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a pneumatic impact hammer, and more particularly to an innovative one which is configured with a two-section pre-pressing rear damper.

2. Description of Related Art Including Information Disclosed Under 37 CFR 1.97 and 37 CFR 1.98

The impact hammer referred to in the present invention is a heavy-duty pneumatic tool, which allows a tapered or flat tool head to be assembled onto its hammering end to form an auxiliary tool for drilling, chiseling and refitting of concrete structurea in a construction project.

According to the structural configuration of conventional impact hammers, a heavy main body of the impact hammer is generally configured to maintain the operational stability and prevent its jumping arising from strong vibration. Yet, given the function of power and anti-power, the main body of the heavy-duty impact hammer may not jump in the operation, but the anti-power when hammering the object with the tool head will generate violent vibration, making it difficult for users to manually hold the tool and even resulting in fatigue or personal injury, etc.

For the aforementioned reasons, breakthrough improvement has to be made for the damping and buffering structure of said impact hammer; in order to strengthen the absorbing power for the vibration of rear seat during hammering of the impact hammer. A double-damping suspension mechanism has been configured in a manner that a damper is assembled correspondingly at front and rear ends of the inner casing and outer barrel. It is found from actual applications that, the conventional single-sided damping structure can realize good shock-absorbing and buffering effect for the rear seat, but the impact force of the internal piston of the impact hammer is excessively absorbed, leading to obvious decline of the impact force of the impact hammer.

Thus, to overcome the aforementioned problems of the prior art, it would be an advancement if the art to provide an improved structure that can significantly improve the efficacy.

Therefore, the inventor has provided the present invention of practicability after deliberate experimentation and evaluation based on years of experience in the production and development of related products.

BRIEF SUMMARY OF THE INVENTION

Based on the structural configuration of the two-section pre-pressing rear damper, its elastic force is pre-pressed to ensure that it is constantly larger than that of the front damper (without the same elastic force balance of front/rear damper arising from free floatation of the internal slide). When the internal slide of the impact hammer yields recoil force under the impaction of the piston, the two-section pre-pressing rear damper is employed to realize stronger buffering effect, so that the impact force of the piston is not much affected, thereby improving the impact efficiency and yielding excellent buffering effect with better applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
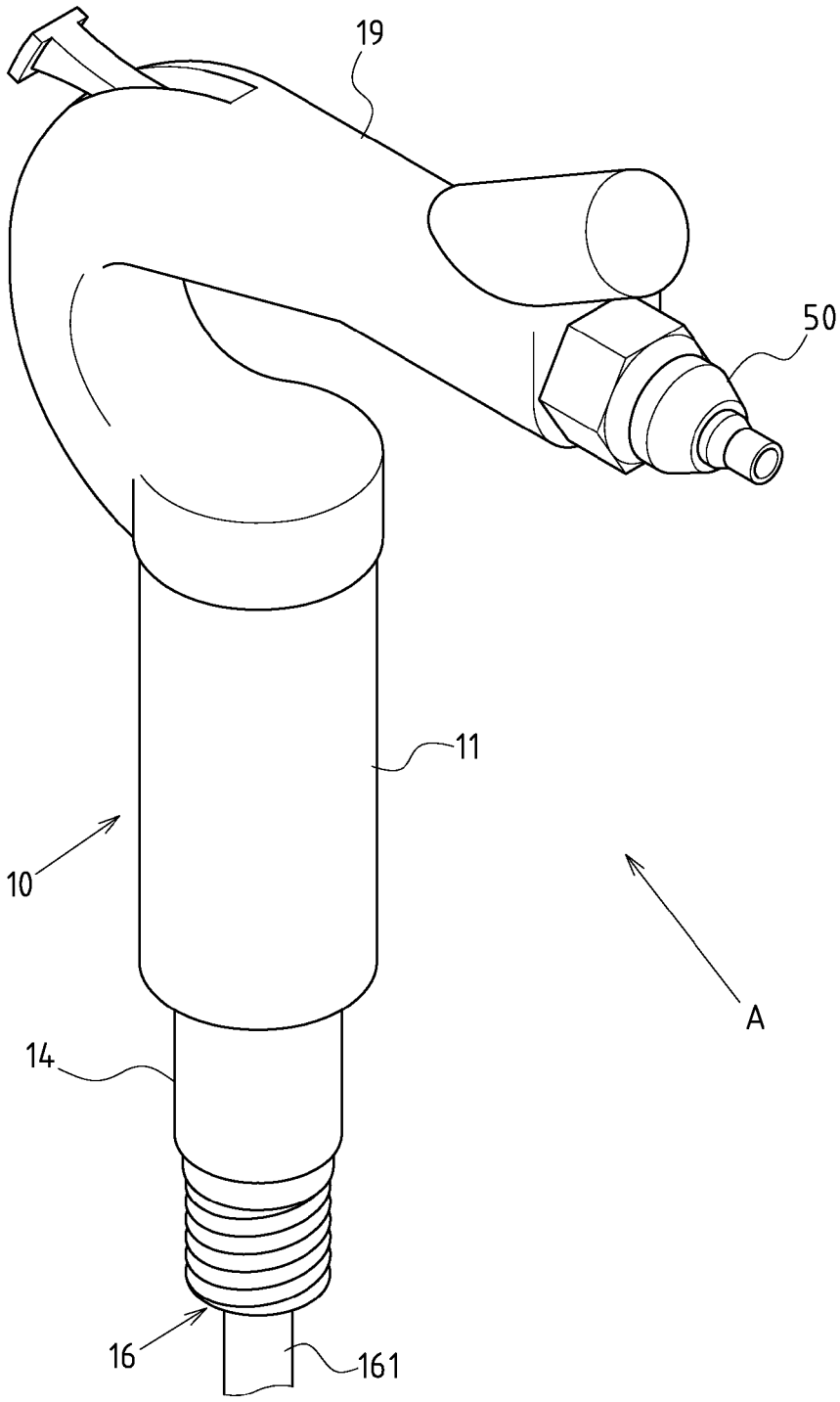
FIG. 1 shows an upper perspective external view of the preferred embodiment of the impact hammer of the present invention.

FIGS. 1-4 depict preferred embodiments of an impact hammer of the present invention with pre-pressing damping and buffering effects which are provided for only explanatory objective for patent claims.

The impact hammer A includes a main body 10, comprising of an outer barrel 11, an air inlet 12, an internal slide 13, an actuating cylinder 14 and an air flow switching module 15. The air inlet 12 is placed at rear end of the outer barrel 11. The internal slide 13 is slidably accommodated between front end wall 111 and rear end wall 112 of a holding space 110 within the outer barrel 11. The actuating cylinder 14 is arranged at front end of the internal slide 13, and the front end of the actuating cylinder 14 is protruded from the front end of the outer barrel 11 to form a tool head coupling portion 16. The air flow switching module 15 is assembled at the rear end of the actuating cylinder 14 to control the movement of the piston 17 within the actuating cylinder 14. Moreover, the rear end of the actuating cylinder 14 is provided with an air inlet duct 18 that can be slidably extended and inserted into the air inlet 12.

A front damper 20 is assembled between the front end of the internal slide 13 of the main body 10 and the front end wall 111 of the holding space 110.

Figure 2:
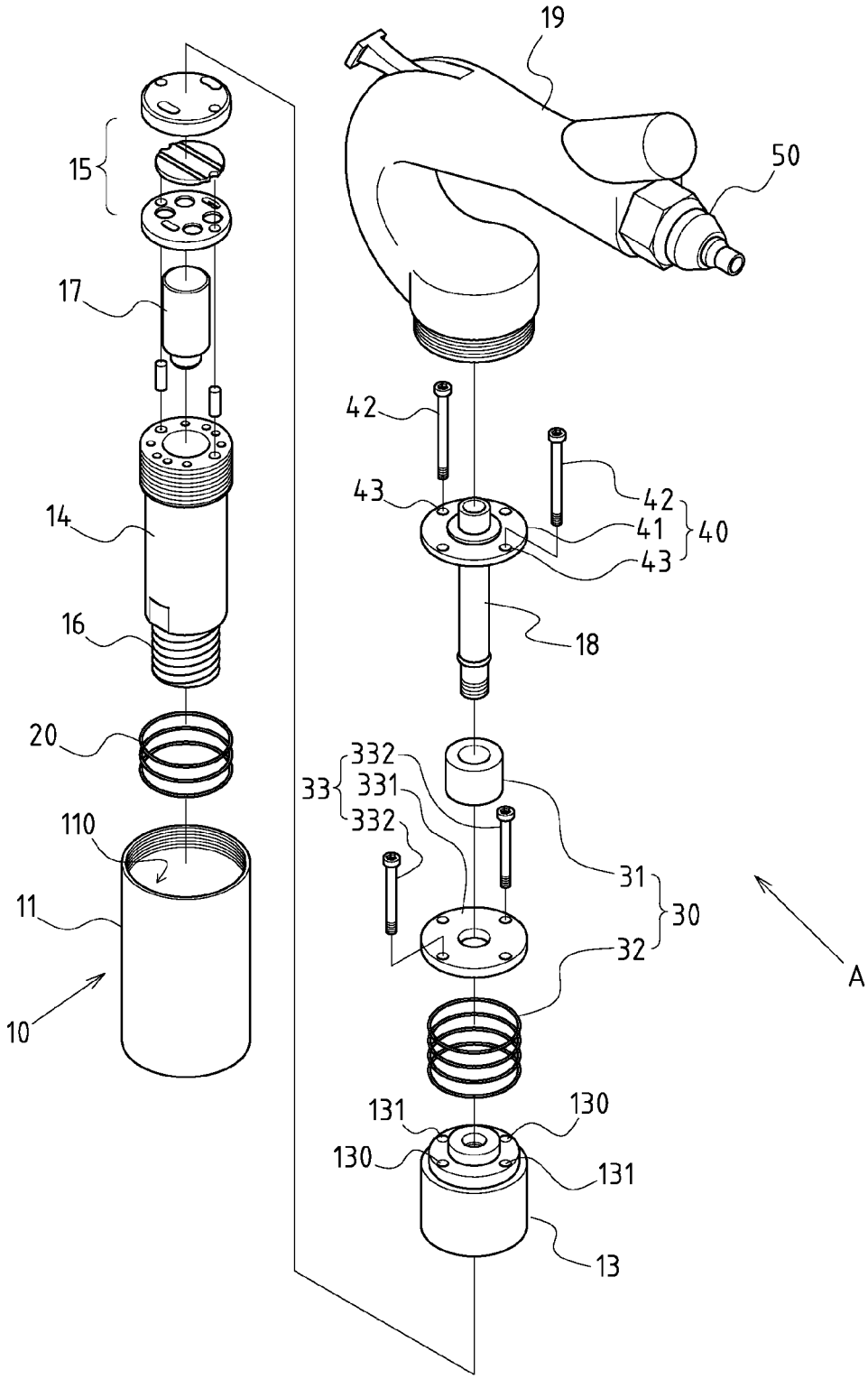
FIG. 2 shows an exploded perspective view of the preferred embodiment of the impact hammer of the present invention.
Figure 3:
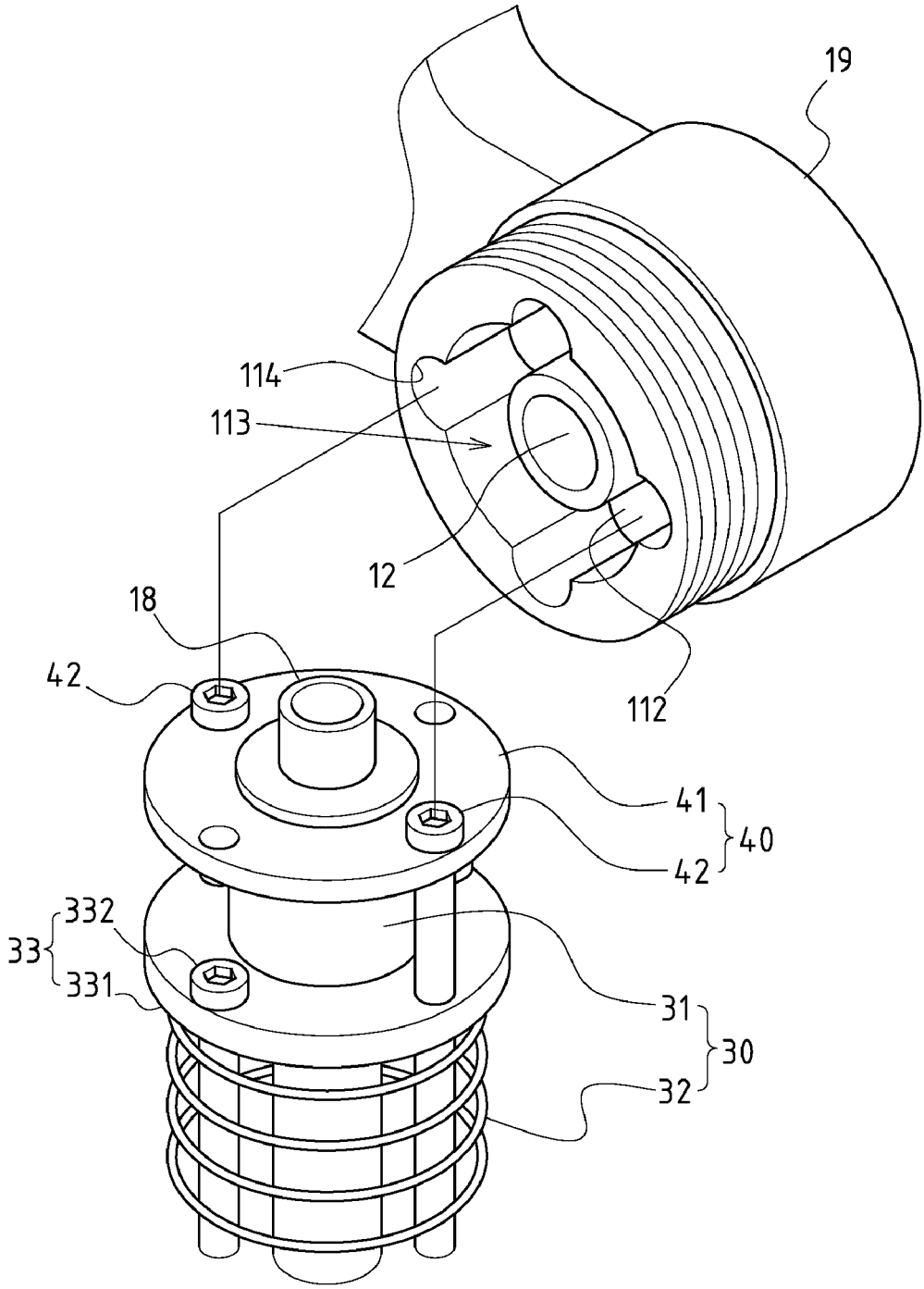
FIG. 3 shows an exploded perspective view of partial structure of the present invention.
Figure 4:
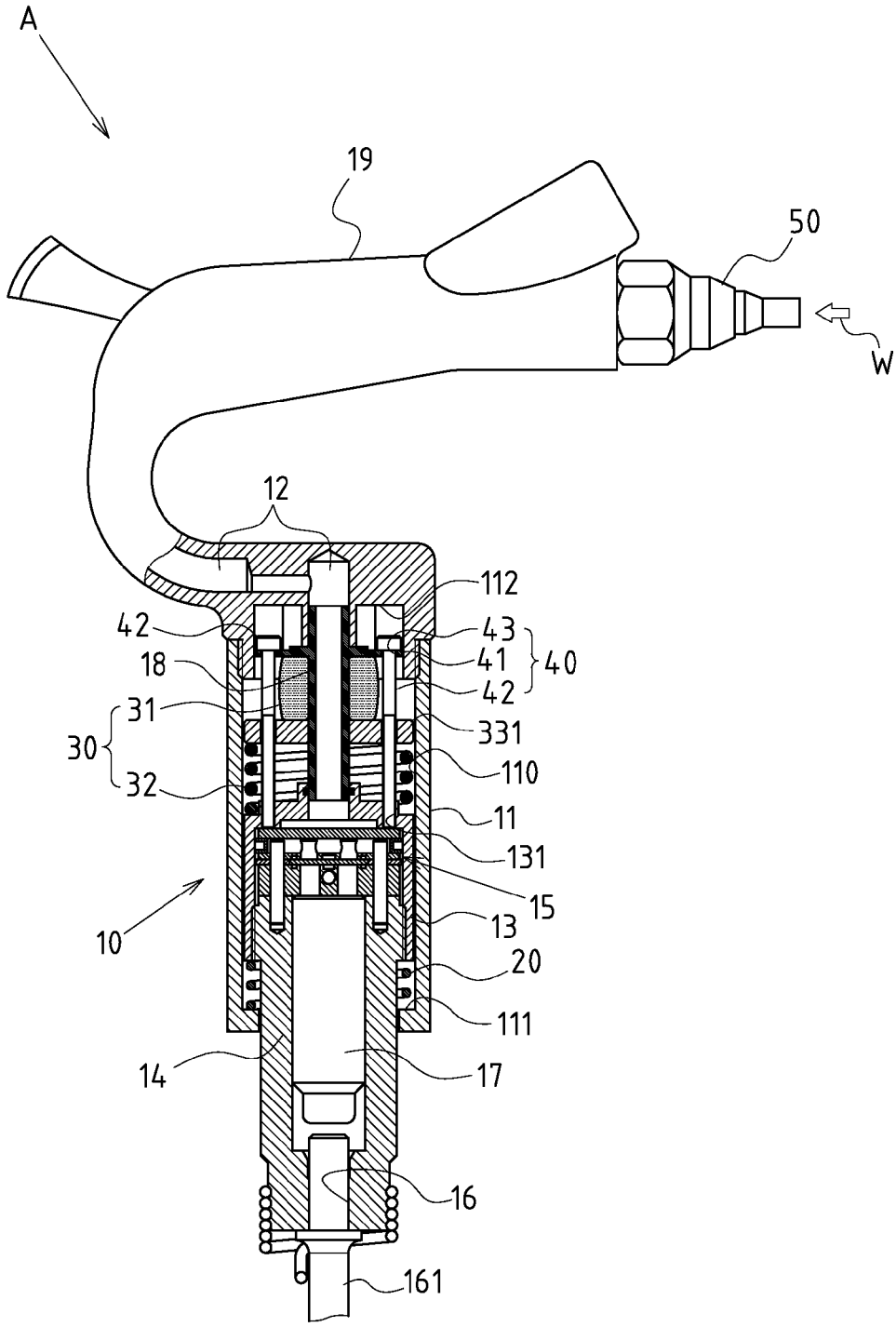
FIG. 4 shows a cross sectional view of the preferred embodiment of the impact hammer of the present invention.
Figure 5:
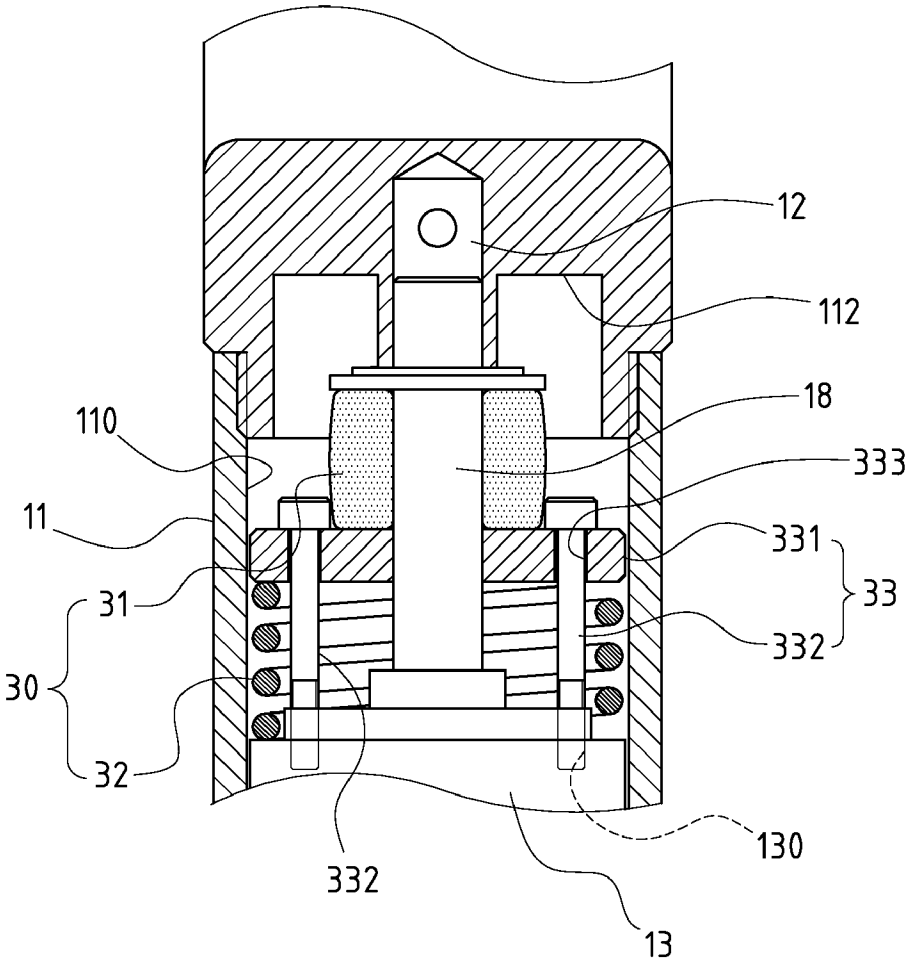
FIG. 5 shows another cross sectional view of partial structure of FIG. 4.
Figure 6:
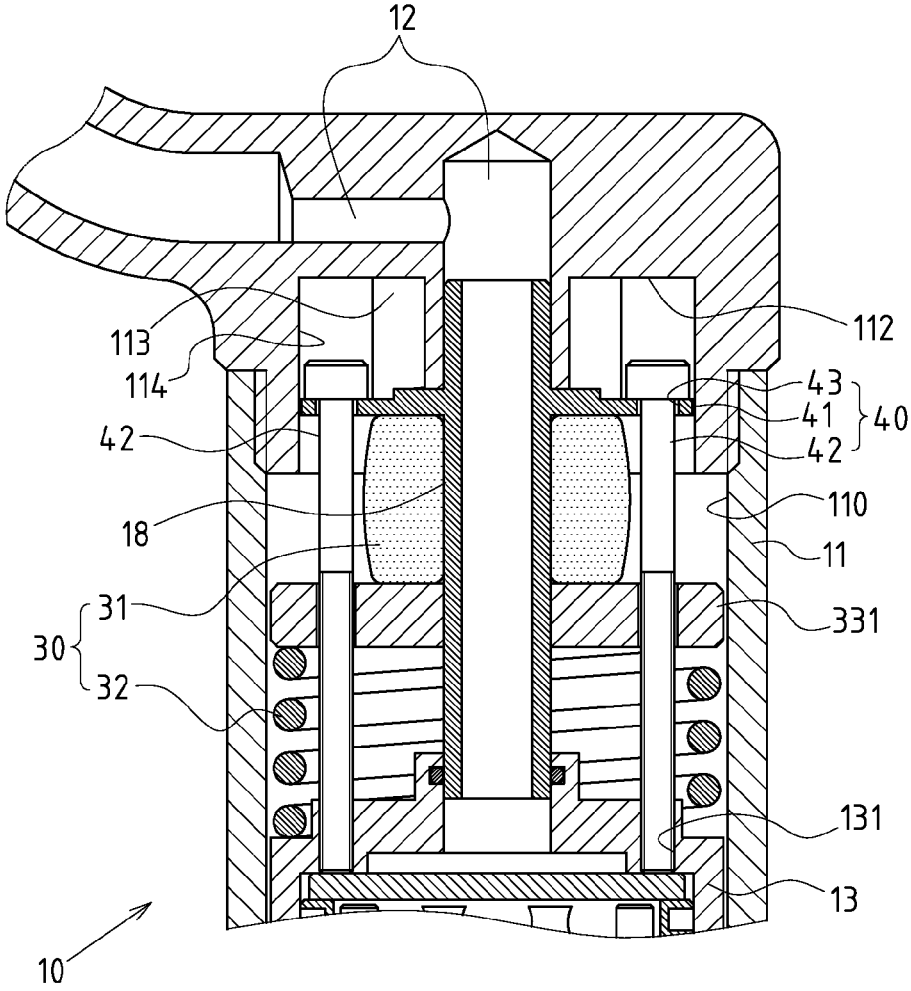
FIG. 6 shows a partially enlarged cross sectional view of FIG. 4.

A two-section pre-pressing rear damper 30 is assembled between the rear end of the internal slide 13 of the main body 10 and the rear end wall 112 of the holding space 110. Said two-section pre-pressing rear damper 30 comprises: superposed upper elastic buffer 31 and lower elastic buffer 32, of which at least the lower elastic buffer 32 is pressed by a pre-pressing member 33 to the preset degree. Referring to FIGS. 2, 3 and 4, the pre-pressing member 33 of the preferred embodiment comprises of a press plate 331 and a plurality of positioning bolts 332. The press plate 331 is abutted onto the top of the lower elastic buffer 32, and also provided with a plurality of through-holes 333 for threading of the positioning bolt 332. Moreover, a plurality of tapped holes 130 is set at the rear end of the internal slide 13 of the main body 10 for bolting of the positioning bolt 332.

Figure 7:
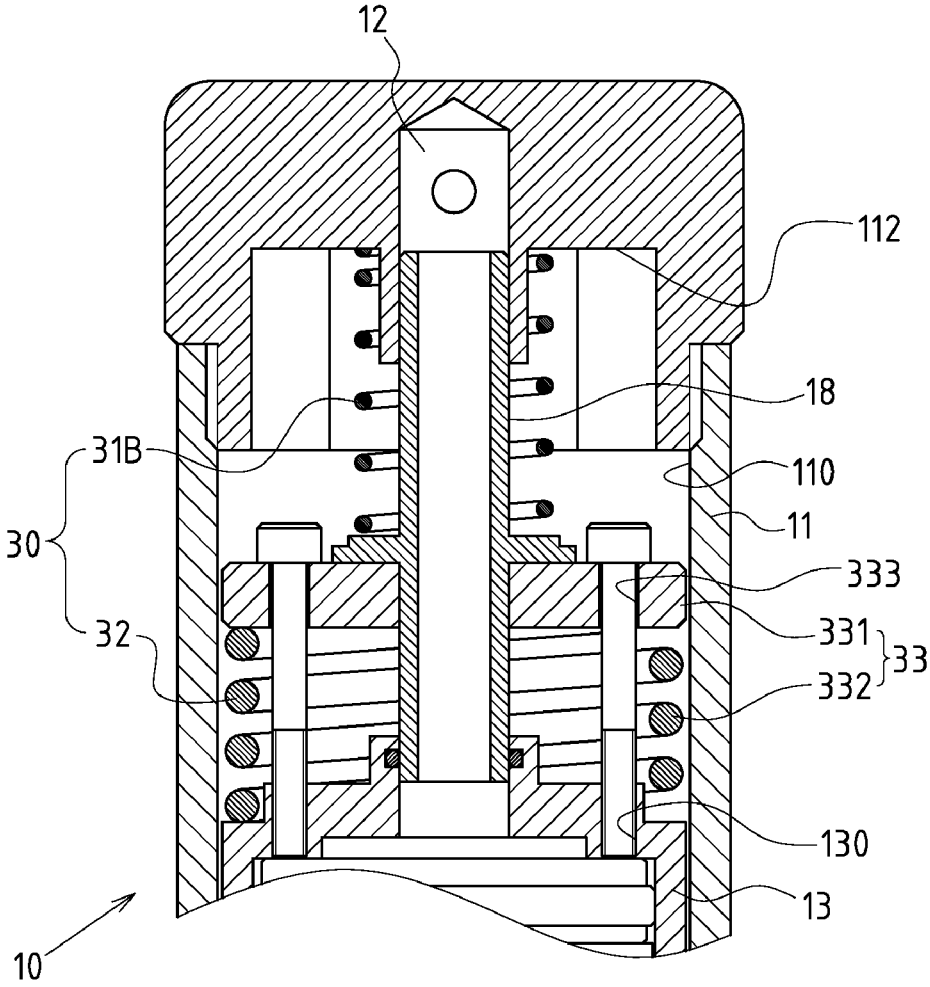
FIG. 7 shows another cross sectional view of the upper elastic buffer of the present invention.

Of which, the upper elastic buffer 31 of the two-section pre-pressing rear damper 30 is a cylindrical block made of elastic material (e.g. rubber and silica gel). Referring to FIG. 7, the upper elastic buffer 31B is made of a spiral spring.

Referring to FIGS. 2, 3 and 4, the upper elastic buffer 31 of the two-section pre-pressing rear damper 30 can also be pre-pressed by a second pre-pressing member 40 to the preset degree. The second pre-pressing member 40 comprises of a pressing strip 41 and a plurality of positioning bolts 42, of which the pressing strip 41 is provided with a plurality of through-holes 43 for threading of the positioning bolt 42, and the bottom of said positioning bolt 42 is bolted securely into the tapped hole 131 at rear end of the internal slide 13 of the main body 10. Moreover, a locating slot 113 is recessed onto the rear end wall 112 of the main body 10, and fitted with a directional embedding trough 114 for mating with the head of the positioning bolt 42. This enables directional positioning between the internal slide 13 and main body 10, and prevents rotation of the internal slide 13.

Of which, said main body 10 also comprises of a handle 19, which is set at rear end of the outer barrel 11 of the main body 10 with C-shaped extension. Moreover, a rear-set air inlet coupling portion 50 is assembled at rear end of the handle 19 for guiding of air pressure.

Based upon above-specified structural configuration, the present invention is operated as follows:

Referring to FIG. 4 for the air flow path of said impact hammer A, when external air pressure W is guided through the rear-set air inlet coupling portion 50, it passes through the handle 19 and enters into the air inlet 12 at rear end of the main body 10. Next, air pressure is guided through air inlet duct 18 into air flow switching module 15 and then into the actuating cylinder 14. In this process, the air flow switching module 15 is used for automatically splitting and switching the air pressure path into a preset state, so that the piston 17 within the actuating cylinder 14 can move rapidly up and down, enabling the tool head 161 of the tool head coupling portion 16 to generate expected impact force.

The core configuration of the impact hammer A of the present invention lies in the technical characteristic of said two-section pre-pressing rear damper 30. When the piston 17 within the actuating cylinder 14 generates impact movement to make the internal slide 13 yield a recoil force, the lower elastic buffer 32 of the two-section pre-pressing rear damper 30 is pre-pressed by the pre-pressing member 33 into a preset state, so the elastic force of the two-section pre-pressing rear damper 30 is constantly larger than that of the front damper 20, preventing the same elastic force balance of front/rear damper arising from free floatation of the internal slide 13. That is to say, when the internal slide 13 of the impact hammer yields recoil force under the impaction of the piston 17, the two-section pre-pressing rear damper 30 is employed to realize stronger buffering effect, so that the impact force of the piston 17 is not much affected, thereby improving the impact efficiency and yielding excellent buffering effect.

I claim:

1. An impact hammer with pre-pressing damping and buffering effect comprising:

a main body comprising:

a handle;

an outer barrel;

an air inlet;

an internal slide;

an actuating cylinder; and an air flow switching module, of which, the air inlet is placed at a rear end of the outer barrel, the internal slide is slidably accommodated between front and rear end walls of a holding space within the outer barrel, the actuating cylinder is arranged at front end of the internal slide, and the front end of the actuating cylinder is protruded from the front end of the outer barrel to form a tool head coupling portion, the air flow switching module is assembled at the rear end of the actuating cylinder to control the movement of the piston within the actuating cylinder, moreover, the rear end of the actuating cylinder is provided with an air inlet duct that can be slidably extended and inserted into the air inlet;

a front damper, assembled between the front end of the internal slide of the main body and the front end wall of the holding space; and a two-section pre-pressing rear damper, assembled between the rear end of the internal slide of the main body and the rear end wall of the holding space, said two-section pre-pressing rear damper comprises: superposed upper and lower elastic buffers, of which at least the lower elastic buffer is pressed by a pre-pressing member to the preset degree.

2. The structure defined in claim 1, wherein the upper elastic buffer of the two-section pre-pressing rear damper is a cylindrical block made of elastic material.

3. The structure defined in claim 1, wherein the upper elastic buffer of two-section pre-pressing rear damper is made of a spiral spring.

4. The structure defined in claim 1, wherein the pre-pressing member for the lower elastic buffer comprises:

a press plate; and a plurality of positioning bolts, wherein the press plate is abutted onto the top of the lower elastic buffer, said press plate is provided with a plurality of through-holes for threading of the positioning bolt, and a plurality of tapped holes is set at the rear end of the internal slide of the main body for bolting of the positioning bolt.

5. The structure defined in claim 1, wherein the upper elastic buffer of the two-section pre-pressing rear damper can also be pre-pressed by a second pre-pressing member to the preset degree; the second pre-pressing member comprises of a pressing strip and a plurality of positioning bolts, so that a locating slot is recessed onto the rear end wall of the main body; the locating slot is fitted with a directional embedding trough for mating with the head of the positioning bolt of the second pre-pressing member.

6. The structure defined in claim 1, wherein said handle is set at said rear end of the outer barrel of the main body.

7. The structure defined in claim 6, wherein a rear-set air inlet coupling portion is assembled at said rear end of the handle.

* * * * *